US005596478A

United States Patent [19]

Ohmi et al.

[11] Patent Number: 5,596,478

[45] Date of Patent: Jan. 21, 1997

[54] APPARATUS FOR NEUTRALIZING CHARGED BODY

[75] Inventors: Tadahiro Ohmi, 1-17-301, Komegabukuro 2 chome, Aoba-ku, Sendai-shi, Miyagi-ken 980; Hitoshi Inaba, Tokyo, both of Japan

[73] Assignees: Tadahiro Ohmi, Miyagi-ken; Takasago Netsugaku Kogyo Kabushiki-Kaisha, Tokyo, both of Japan

[21] Appl. No.: 185,829

[22] PCT Filed: Jul. 24, 1992

[86] PCT No.: PCT/JP92/00948

§ 371 Date: Jan. 24, 1994

§ 102(e) Date: Jan. 24, 1994

[87] PCT Pub. No.: WO93/02467

PCT Pub. Date: Feb. 4, 1993

[30] Foreign Application Priority Data

Jul. 25, 1991 [JP] Japan ..... 3-208562

[51] Int. Cl.[6] ..... H05F 3/06

[52] U.S. Cl. ..... 361/212; 361/213

[58] Field of Search ..... 361/212, 213, 361/229, 234, 231; 250/324, 326, 423 F

[56] References Cited

U.S. PATENT DOCUMENTS 4,827,371 5/1989 Yost ..... 361/213

5,255,153 10/1993 Nozawa et al. ..... 361/234

FOREIGN PATENT DOCUMENTS 60-3121 1/1985 Japan .

3-91915 4/1991 Japan .

*Primary Examiner*—Fritz Fleming

*Attorney, Agent, or Firm*—Baker & Daniels

[57] ABSTRACT

An apparatus which can neutralize charge bodies such as processed substrates for semiconductor device and for flat display, free from electromagnetic noise, impurity contamination, and residual potentials. To process in a prescribed way a wafer(5) to be processed, the wafer(5) is, for example, moved from a pretreatment chamber(2) to a low pressure reaction chamber(3). In this case, a gas, which does not react on the wafer, such as nitrogen and argon, is introduced into the pretreatment chamber(2), and is kept under a predetermined pressure by a vacuum pump(15). Then, ultraviolet rays are projected in the pretreatment chamber(2) from an ultraviolet rays lamp(11) constituting a means for generating neutralization charge, and positive and negative floating charged particles(electrons and positive ions) are generated by exiting the atmosphere in the chamber(2). Since the charges are removed by projecting the ultraviolet rays from the outside of a case(1) and the case(2) and moreover in a non-contact way, no electromagnetic noise is generated and the residual potentials are vanished too.

14 Claims, 2 Drawing Sheets

APPARATUS FOR NEUTRALIZING CHARGED BODY

TECHNICAL FIELD

The present invention relates to an apparatus for neutralizing charges on bodies which are extremely easily charged and for which it is necessary to avoid a charge, such as processed substrates represented by substrates (wafers) in manufacturing processes of, for example, semiconductor devices, liquid crystal plates in manufacturing processes of flat display apparatuses, EL glass plates and the like.

BACKGROUND ART

In the manufacture of semiconductor devices or flat plate displays, various substrate processing apparatuses (thin film formation apparatuses for forming prespecified thin films on the processed substrate, impurity addition apparatuses for conducting the addition or impurities such as boron, phosphorous, arsenic, and the like) are employed; however, a composition in which all processing apparatuses are built into a single chamber is rare, and it is generally the case that the processing apparatuses are compartmentalized through the medium of a conveyance path under atmospheric pressure or a conveyance passage (tunnel chamber), or via opening and closing mechanisms, from other processing chambers.

However, since the instances of various types of handling of the processed substrates, such as gripping, moving, and the like, are frequent, and particularly since the implements and the like which come into contact with the processed substrate at the time of such handling are normally formed using fluorine resin or silica insulating film or the like in order to avoid metallic contamination of or damage to the processed substrates, the processed substrate is positively (in some cases, negatively) charged as a result of the electrification rank relationship thereof with respect to the implements at the time of contact, and the potential of these processed substrates easily becomes high.

In addition, in order to prevent the depositing of dust on the processed substrate, a gas flow which bas been passed through a filter is normally caused to flow in the vicinity of the processed substrate, and because floating particles, water, and trace amounts of gaseous impurities and the like, even if in very small amounts, are contained in this gas flow, dust is actively deposited on the charged processed substrate, or the interior of the processing apparatus is contaminated. Furthermore, with respect to the conveyance of the processed substrate between apparatuses, the processed substrate is commonly first transferred to a pretreatment chamber and placed on a prespecified installation platform, and is then transferred to a reaction chamber.

In this case, during the transfer of the processed substrates, instances in which the gripping, rubbing, or the like of the processed substrates by means of the handling mechanisms are frequent, and furthermore, the implements comprising the handling mechanisms are normally formed using fluorine resins, silica, or the like in order to avoid metallic contamination of the processed substrates, so that as a result of the electrification rank relationship of the processed substrate with respect to the implements, the processed substrate is positively charged, and easily attains a high potential.

The following methods are commonly known for the prevention of the charging of processed substrates and processed substrate carriers, that is to say, as charge removal mechanisms; first, a method employing an ionizer, that is to say, a method in which corona discharge is generated in an ambient atmosphere in which a processed substrate or a processed substrate carrier is placed, and by means of this, the generated ions and the charges are neutralized, secondly, a method in which the processed substrate is subjected to handling by means of a resin material in which a grounded metallic body or a grounded conductive substance (carbon, metal, or the like) is included, and charges are thus neutralized, and the like.

However, in the first conventional method above, corona discharge in an ambient atmosphere Is employed, so that the generation of electromagnetic noise as a result of this discharge causes electrical disturbance of instruments around the processing apparatus, and the remaining potential of the processed substrate becomes high, so that this is insufficient as a charge removal apparatus. Furthermore, among the ions which are generated, the positive ions are mainly the water ions $(H_2O)_nH^+$, and these water ions $(H_2O)_nH^+$contribute to the growth of a natural oxide film on, for example, the surface of a semiconductor substrate, while the negative ions are largely $CO_3^-$, $NO_x^-$, and $SO_x^-$ ions, and these ions are all strongly oxidizing, and cause the formation of a natural oxide film, in the same manner as the positive ions described above.

On the other hand, in the second conventional method described above, the metal or conductive material is in direct contact with the processed substrate, so that impurities therefrom contaminate the processed substrate, and this causes the generation of dark currents or leak currents.

In processing apparatuses in which a processed substrate is transferred between different atmospheres as described above, even if charged neutralization of the processed substrate is conducted in one atmosphere (for example, in a tunnel chamber), there are cases in which the charging of the processed substrate occurs again as a result of contact with other materials during transfer to another atmosphere (within a pretreatment chamber).

In such cases, there are cases in which it is structurally difficult to conduct charge neutralization by means of the above methods in the latter atmosphere, and furthermore, even if such charge neutralization is conducted, there is a danger that the growth of natural oxide films, operational errors as a result of electromagnetic noise, impurity contamination as a result of conductive substances, the increase in the remaining potential, and the like, will disturb or render impossible the desired processing.

Furthermore, in many processing apparatuses, the atmosphere in the main reaction chamber is of reduced pressure when compared with the ambient air pressure, and accordingly, within pretreatment chambers coupled thereto, it is necessary to establish a reduced pressure which is approximately equivalent to that within the reaction chamber at least prior to the transfer of the processed substrate, and it is necessary to establish a method for the easy removal of charges even in such reduced pressure atmospheres.

The present invention solves the problems present in the conventional technology described above; it has as an object thereof to provide a neutralizing apparatus which is capable, with respect to charged bodies such as processed substrates or processed substrate carriers, to prevent the generation of electromagnetic noise, to completely eliminate remaining potential, to realize an impurity contamination-free state, and to prevent the formation of natural oxide films, the generation of dark currents or leak currents, and emission irregularities in flat plate displays, and which is furthermore capable of conducting the easy neutralization of charges even in the process of transfer between differing atmospheres.

DISCLOSURE OF THE INVENTION

In order to attain the above object, the invention is provided with: a chamber which is capable of storing charged bodies which have been subjected to a prespecified charge, a gas input mechanism for inputting gas which is non-reactive at least with respect to these charged bodies into an interior of said chamber, a neutralization charge generating mechanism for generating ions and electrons capable of selectively neutralizing prespecified charges in an interior of the chamber, and a pressure reduction mechanism for reducing pressure in an interior of the chamber to a level lower than atmospheric pressure.

In one embodiment of the present invention, the neutralization charge generating mechanism is comprising a light source for projecting, into the chamber, ultraviolet rays capable of exciting at least the non-reactive gas within the chamber.

In another embodiment of the present invention, the pressure reduction mechanism is comprising a pressure reduction mechanism for expelling the non-reactive gas introduced into the chamber along with the interior of the chamber.

In another embodiment of the present invention, the chamber communicates, via an opening and closing mechanism, with a reaction chamber for conducting prespecified processes under reduced pressure with respect to the charged bodies.

In another embodiment of the present invention, the pressure reduction mechanism operates so as to set a pressure within the reaction chamber to a level equivalent to that of the pressure within the chamber.

In another embodiment of the present invention, the non-reactive gas is comprising nitrogen gas or argon gas.

In another embodiment of the present invention, the non-reactive gas is comprising a mixed gas of nitrogen gas and argon gas.

In another embodiment of the present invention, the non-reactive gas is comprising a mixed gas in which xenon gas is added to nitrogen gas.

In another embodiment of the present invention, the non-reactive gas is comprising a mixed gas in which xenon gas is added to a mixed gas of nitrogen gas and argon gas.

FUNCTION

In order to easily conduct prespecified processes (for example, epitaxial growth) with respect to charged bodies, for example processed substrates, such as those, for example, in which processed substrates are transferred from a tunnel chamber via a pretreatment chamber to a reduced pressure epitaxial reaction chamber, a gas which does not react with respect to the processed substrate (for example, nitrogen, argon, xenon, and the like) is introduced into the pretreatment chamber, the interior thereof is set to a prespecified pressure (a pressure approximately identical to that within the reaction chamber) by means of a pressure reduction mechanism, ultraviolet rays are projected into the pretreatment chamber from a light source constituting a neutralization charge generating mechanism, the atmosphere within the chamber is excited, and positive and negative floating charged particles (including positive ions and electrons) are generated, and when the processed substrate is charged positively, this positive charge is neutralized by the electrons among the floating charged particles. Furthermore, in the case in which the processed substrate is negatively charged, this negative charge is neutralized by the positive ions among the floating charged particles.

(Description of the References)

2 pretreatment chamber,

5 wafer (processed substrate, charged body),

11 ultraviolet lamp (neutralization charge generating mechanism),

15 exhaust pump (vacuum pump).

BEST MODE FOR THE EXECUTION OF THE INVENTION

Figure 1:
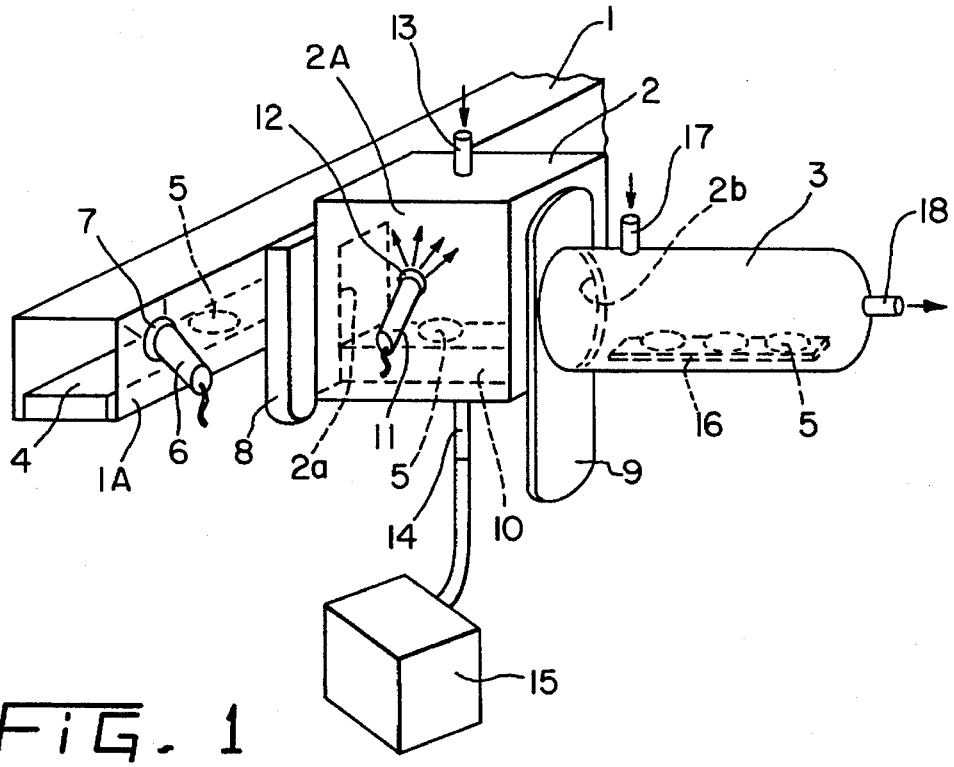
FIG. 1 is a perspective view showing an embodiment of the present invention.

FIG. 1 shows an embodiment in the case in which a neutralization apparatus in accordance with the present invention is applied to a wafer processing apparatus (epitaxial apparatus) in a semiconductor manufacturing process. The present processing apparatus essentially comprises a tunnel chamber 1, which has, longitudinally, an angled-pipe tank shape, a pretreatment chamber 2 having a cubical shape, and a reaction chamber 3 having a longitudinally cylindrical shape.

In the interior of tunnel chamber 1, a transfer conveyer 4 is disposed, and wafers 5 which comprise charged bodies are placed on the transfer conveyor 4. Furthermore, ultraviolet lamp 6, such as a deuterium lamp or the like, comprising a first neutralization charge generating mechanism, is attached to one side wall 1A of the tunnel chamber 1, and the projection side of the ultraviolet lamp 6 faces a transparent window 7 which permits the passage of ultraviolet rays and is formed in this side wall 1A.

In pretreatment chamber 2, input port 2*a* and output port 2*b* are formed so as to be in mutual opposition, and opening and closing mechanisms (gate valves) 8 and 9, respectively, are provided at input port 2*a* and output port 2*b*, and accordingly, pretreatment chamber 2 is in communication with tunnel chamber 1 via input port 2*a*, and is in communication with reaction chamber 3 via output port 2*b*.

Figure 2:
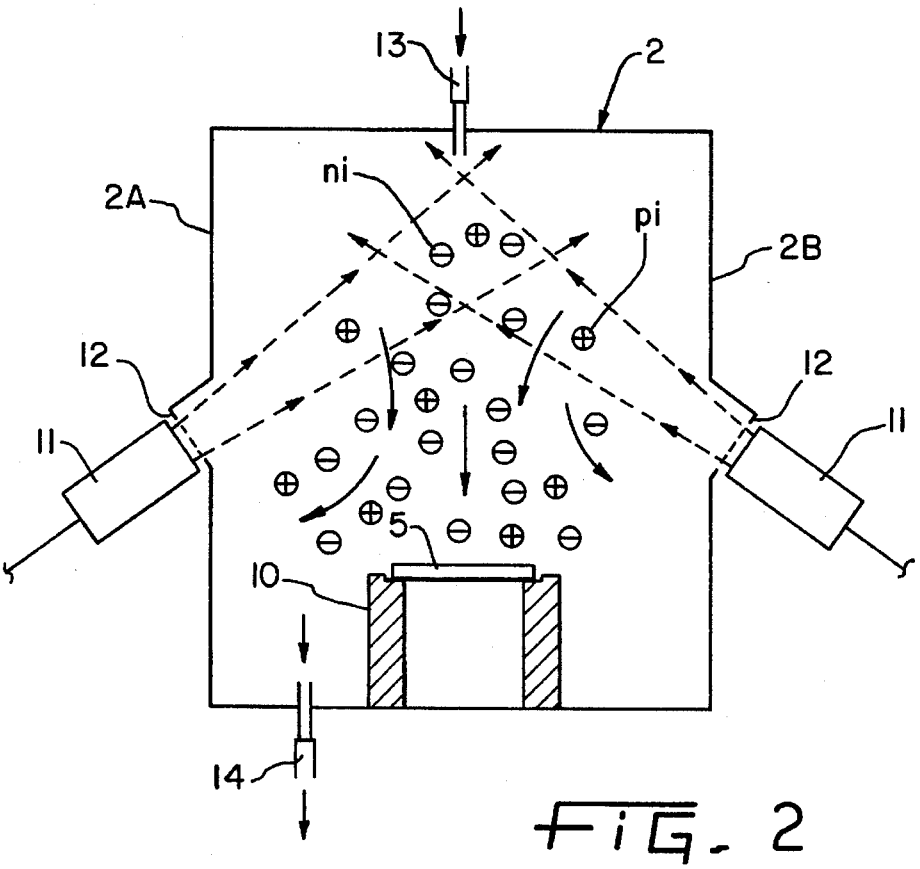
FIG. 2 is a cross-sectional view of the pretreatment chamber of FIG. 1.

Furthermore, as shown in FIG. 2, ultraviolet ray lamps 11 comprising second neutralization charge generating mechanisms are attached to side walls 2A and 2B of pretreatment chamber 2, and the projection sides of these ultraviolet ray lamps 11 face transparent windows 12 which permit the passage of ultraviolet rays within a pre-specified range and are formed in the side walls 2A and 2B. Transparent windows 12 (and transparent window 7 as well) are formed from materials which permit the passage of ultraviolet rays within a broad range; for example, synthetic silica, $CuF_2$, $NgF_2$, LiF, and the like.

Within pretreatment chamber 2, installation platforms 10 for the placement of wafers 5 are provided, and via handling mechanisms which are not depicted in the diagram, wafers 5 can be moved from transfer conveyer 4 onto installation platforms 10. Furthermore, a gas input tube 13 is provided in the upper surface portion of pretreatment chamber 2, and in the lower surface portion thereof, a gas output tube 14 is provided.

A gas supply source of a gas which is non-reactive at least with respect to wafers 5, such as, for example, argon gas, nitrogen gas, or a mixture of xenon gas with these gasses, is connected to gas input tube 13, and an exhaust pump 15 is connected to gas output tube 14 as a pressure reducing mechanism. Permissible non-reactive gasses include nitrogen gas, argon gas, or xenon gas, used exclusively, a mixed gas in which a trace amount of xenon gas is added to nitrogen gas or argon gas, or a mixed gas in which a trace amount of xenon gas is added to a mixed gas of nitrogen gas and argon gas. However, when nitrogen gas and argon gas are compared, argon gas is more easily excited, so that under identical ultraviolet ray projection conditions, the neutralization efficiency is higher in the case in which argon gas is used.

A reaction processing platform 16 is provided within reaction chamber 3, and via handling mechanisms which are not depicted in the diagram, wafers 5 can be moved from installation platforms 10 onto reaction processing platform 16. An atmospheric gas (nitrogen gas, or the like) input tube 17 is provided in reaction chamber 3, an atmospheric gas output tube 18 is also provided, and output tube 18 is connected to an exhaust mechanism which is not depicted in the diagram.

Next, the operation of the present embodiment having the construction described above will be explained.

Normally, a prespecified flow amount of nitrogen gas is caused to flow within tunnel chamber 1, and nitrogen gas is strongly directed onto wafers 5 on transfer conveyer 4. Accordingly, wafers 5 are negatively charged, and reach a considerably high potential, so that ultraviolet ray lamp 6 is lit, ultraviolet rays having a pre-specified wavelength band are projected, and the charge on wafers 5 is neutralized.

That is to say, at normal temperatures, when ultraviolet rays from a deuterium lamp or the like are projected in a state in which nitrogen gas has been introduced into tunnel chamber 1, the nitrogen gas molecules introduced into chamber 1 are excited and become ionized, and these positively ionized molecules and the negative charge present on wafers 5 are electrically neutralized, and the potential of wafers 5 is lowered (to a level of tens of [V] or less).

Next, when gate valve 8 is opened and tunnel chamber 1 and pretreatment chamber 2 communicate, the operation of the handling mechanisms becomes possible, and desired wafers 5 within tunnel chamber 1 are moved to the interior of pretreatment chamber 2.

When wafers 5 are moved within pretreatment chamber 2 as a result of the operation of the handling mechanisms, gate valve 8 is closed, and ultraviolet ray lamp 11 is lit. At this time, a non-reactive gas (a gas in which trace amounts of xenon gas are mixed with nitrogen gas or the like) is introduced into pretreatment chamber 2 via gas input tube 13, and exhaust pump 15 is put into operation, so that the interior of pretreatment chamber 2 is set to a pressure which is approximately equivalent to that within reaction chamber 3 (for example, 14 [Torr]).

In the same manner as in the case of the interior of tunnel chamber 1, by means of the projecting of ultraviolet ray lamp 11, the electrons generated as a result of the excitation of the gas molecules introduced into pretreatment chamber 2 and the positive charge on wafers 5 are electrically neutralized, and the potential of wafers 5 is reduced in an extremely short period of time to a low level (less than 50[V]).

Figure 3:
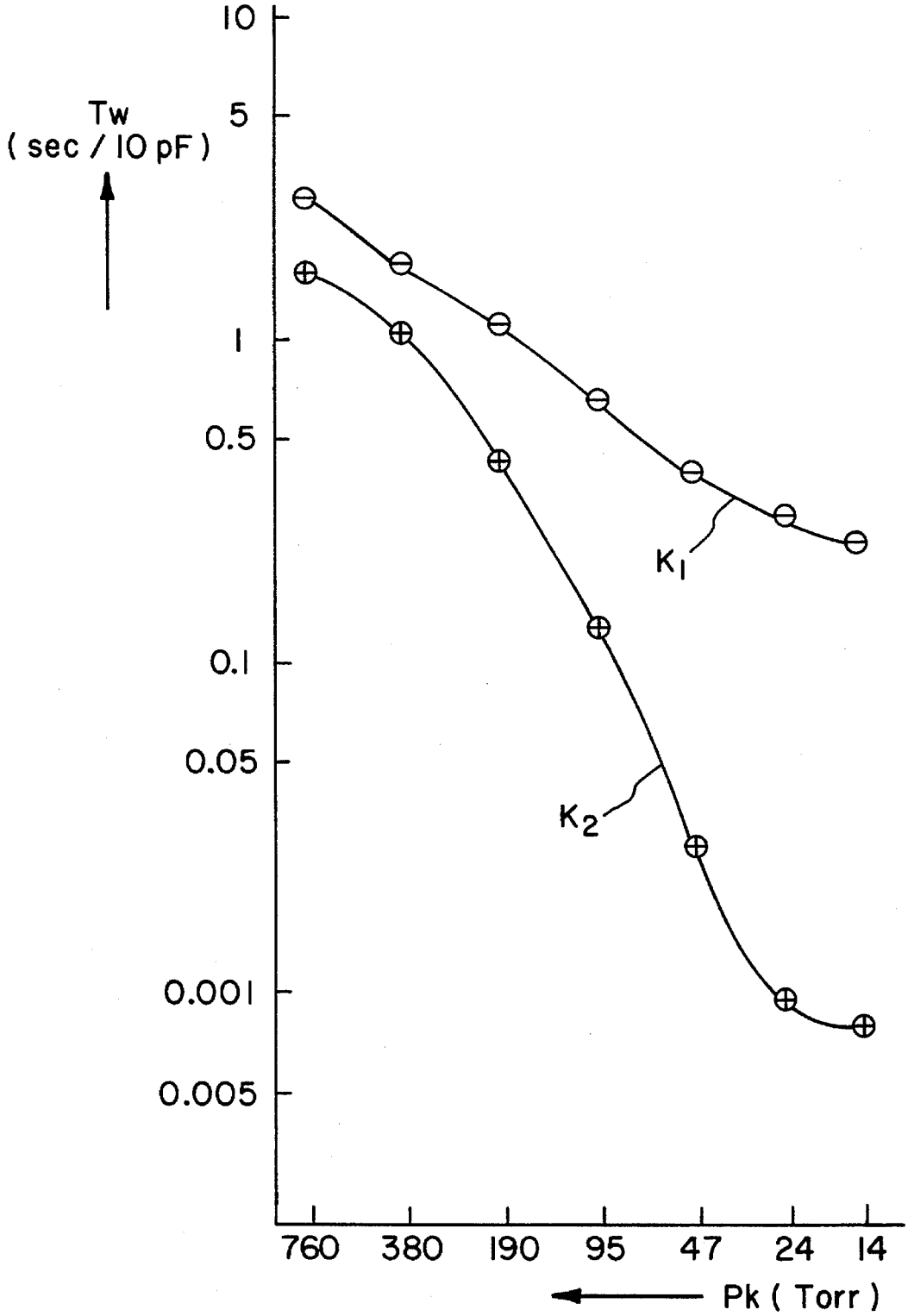
FIG. 3 is a graph showing the decline over time in electric potential of a charged body with respect to the atmospheric pressure within the chamber.

FIG. 3 shows the relationship of the substrate potential decrease time Tw (the time required for a substrate charged to a potential of +500 [V] to reach a potential of +50 [V]) with respect to the atmospheric pressure Pk [Torr] of the freely selected chamber.

In FIG. 3, curve $K_1$ shows an example of measurement in the case in which the processed substrate is negatively charged, while $K_2$ shows an example of measurement in the case in which the processed substrate is positively charged. The above decrease time Tw has a value which is displayed in terms of [sec/10pF], showing the case in which the processed substrate has a capacitance of 10 [pF], since the charge of the processed substrate depends on the capacitance of the substrate itself. Accordingly, in the case in which the processed substrate has a capacitance of, for example, 20 [pF], the value of Tw corresponding to the same value of Pk would be doubled.

As can be understood from the Figure, in the case in which the processed substrate is negatively charged, for example, when the pressure Pk within the chamber has a value of 760 [Torr], then the value of Tw is approximately 3 [sec/10pF], whereas when pressure Pk is reduced to 14 [Torr] than the value of Tw becomes approximately 0.2 [sec/10pF], and the reduction of charge can be conducted roughly 15 times as fast as a result of the reduction of pressure. Furthermore, in the case in which the processed substrate is positively charged, for example, when the pressure Pk has a value of 760 [Torr], than Tw has a value of approximately 1.6 [sec/10pF], whereas when pressure Pk is reduced to 14 [Torr], than the value of Tw becomes approximately 0.008 [sec/10pF], and the reduction of charge can be conducted approximately 200 times as fast as a result of the reduction of pressure. The reason for this is that when the particles contributing to neutralization are electrons, the speed of movement is faster than when these particles are ions.

The mechanism of the charge reduction described above is thought to be such that, in the case in which ultraviolet rays are projected into the non-reactive gas atmosphere within the chamber, the gas molecules in the vicinity of processed substrate 5 are ionized to positive and negative charged particles pi and ni (positive ions of the non-reactive gas molecules, and electrons) (see FIG. 2), and since the degree of this ionization is affected by the atmosphere within the chamber, in the case in which processed substrate 5 is charged to a positive or negative high potential on the level of several [kV], for example, if a low pressure atmosphere is present, it is possible to reduce the remaining potential to a low potential in an extremely short period of time. However, the speed of the reduction of potential differs, depending on whether the initial charge polarity of processed substrate 5 is positive or negative. Furthermore, the speed of neutralization becomes higher as the ultraviolet ray projecting unit is moved closer to the wafer.

In FIG. 3, results were shown with respect to a case in which the atmospheric pressure Pk of the chamber was reduced to a level of 14 [Torr]; however, it is possible to reduce pressure Pk to a pressure at which floating charged particles which are capable of the selective neutralization of processed substrate charge can be generated; concretely, Pk can be reduced to a pressure of at least $10^{-3}$–$10^{-5}$ [Torr].

When the above wafer 5 is moved from processing chamber 2 to reaction chamber 3 by means of handling mechanisms, as a result of contact with these handling mechanisms, the potential of the substrate is raised slightly; however, at this time, the interior of reaction chamber 3 has already been reduced to an atmospheric pressure which is roughly equivalent to that within pretreatment chamber 2, so that there is no danger that the floating particles will be deposited thereon. In addition, in cases in which the increase in potential of wafer 5 within reaction chamber 3 is a problem, it is desirable to employ a structure in which the projecting of ultraviolet rays is conducted from the exterior of reaction chamber 3.

Furthermore, under pressures less than 200 Torr, the atmospheric gas (ionized gas) is not limited to a non-reactive gas ($N_2$, Ar, and the like), but rather, a reactive gas (oxygen, chlorine gas, or the like) may be employed.

This indicates that even when the processing chamber is placed in a reactive gas atmosphere, insofar as pressure is reduced, it is possible to reduce charge.

When the amount of ions reaching the charge-removal wafer per unit time period in a reduced pressure atmosphere in the case in which the oxygen concentration was 20 percent and 100 percent was compared with that in a 100 percent $N_2$ gas atmosphere, it was found that when an oxygen concentration of 20 percent was employed, at a pressure of approximately 10 Torr, roughly the same amount of ions reached the substrate as was the case in a pure $N_2$ atmosphere. In an atmosphere of 100 percent oxygen, equivalence was reached at a pressure of approximately 1 Torr. Furthermore, the amount of ions reaching the substrate in a pure $N_2$ atmosphere at atmospheric pressure was equivalent to that in a 20 percent oxygen atmosphere at a pressure of approximately 200 Torr (the amount of ions reaching the substrate per charge-removable unit time period was at a minimum 109 or more).

INDUSTRIAL APPLICABILITY

As explained above, the present invention provides the following: a chamber which is capable of storing charged bodies which have been subjected to a prespecified charge, a gas input mechanism for inputting gas which is non-reactive at least with respect to the charged bodies into an interior of the chamber, a neutralization charge generating mechanism for generating ions and electrons capable of selectively neutralizing prespecified charges in an interior of the chamber, and a pressure reduction mechanism for reducing pressure in an interior of the chamber to a level lower than atmospheric pressure, so that it is possible to rapidly overcome the charging of easily charged materials within a chamber, and it is possible to conduct the neutralization of easily charged materials in a non-reactive gas atmosphere, so that this process is free from electromagnetic noise and impurity contamination, and residual potentials can be completely eliminated, while undesirable occurrences such as the formation of a natural oxide film on the charged substance, or the generation of dark currents or leak currents, or the like, can be prevented in advance.

As one preferred feature of the present invention, the neutralization charge generating mechanism is comprising a light source for projecting, into the chamber, ultraviolet rays capable of exciting at least the non-reactive gas within the chamber, so that charge removal can be conducted with a simple structure, and in comparison with conventional charge removal by means of an ionizer or the like, it is possible to reduce the remaining potential to a level of 0, so that this method is clearly superior, and it is possible to eliminate charge at at least an approximately equivalent speed.

As one preferred feature of the invention, the pressure reduction mechanism is comprising a pressure reduction mechanism for expelling the non-reactive gas introduced into the chamber along with the interior of the chamber, so that, in the state in which a non-reactive gas is being passed, it is easily possible to maintain the interior of the chamber in a continuously fresh state.

As another preferred feature of the invention, the chamber communicates, via an opening and closing mechanism, with a reaction chamber for conducting prespecified processes under reduced pressure with respect to the charged bodies, so that the invention is useful in applications to various types of processing apparatuses in cases in which the charged bodies are processed substrates such as semiconductor substrates, glass plates for liquid crystal displays, plastic substrates, disc substrates, and the like.

As another preferred feature of the invention, the pressure reduction mechanism operates so as to set a pressure within the reaction chamber to a level equivalent to that of the pressure within the chamber, so that it is possible to coordinate the above chamber and the reaction chamber, and this is particularly advantageous in the case in which the invention is applied to the processing apparatus described above.

As another preferred feature of the invention, the non-reactive gas comprises nitrogen gas or argon gas or a mixed gas thereof, so that handling is easy, and in particular in the case in which this gas comprises nitrogen gas, the costs are low and the gas can be easily obtained, so that this is preferable.

As another preferred feature of the present invention, the non-reactive gas comprises nitrogen gas or argon gas, or a mixed gas thereof, to which trace amounts of xenon gas are added, so that it is possible to effectively use xenon gas, which increases the excitation efficiency of the chamber atmosphere, but is expensive and difficult to obtain.

We claim:

1. An apparatus for neutralizing charged bodies which have been subjected to a charge, comprising:

a chamber having an interior for storing said charged bodies;

a gas input means for introducing a gas into the interior of said chamber, said gas being non-reactive with respect to said charged bodies when said charged bodies are stored in said chamber;

a neutralization charge generating means for generating ions and electrons capable of selectively neutralizing said charged bodies when said charged bodies are stored in said chamber, said neutralization charge generating means comprising a light source for projecting, into said chamber, ultraviolet rays capable of exciting the non-reactive gas within said chamber; and a pressure reduction means for reducing pressure in the interior of the chamber to a level lower than atmospheric pressure.

2. An apparatus for neutralizing charged bodies in accordance with claim 1, wherein said pressure reduction means comprises a pressure reduction mechanism for expelling the non-reactive gas introduced into said chamber.

3. An apparatus for neutralizing charged bodies in accordance with claim 2, wherein said chamber communicates, via an opening and closing mechanism, with a reaction chamber for conducting prespecified processes under reduced pressure with respect to said charged bodies.

4. An apparatus for neutralizing charged bodies in accordance with claim 3, wherein said pressure reduction means operates so as to set a pressure within said reaction chamber to a level equivalent to that of a pressure within said chamber.

5. An apparatus for neutralizing charged bodies in accordance with claim 1, wherein said chamber communicates, via an opening and closing mechanism, with a reaction chamber for conducting prespecified processes under reduced pressure with respect to said charged bodies.

6. An apparatus for neutralizing charged bodies in accordance with claim 5, wherein said pressure reduction means operates so as to set a pressure within said reaction chamber to a level equivalent to that of a pressure within said chamber.

7. An apparatus for neutralizing charged bodies in accordance with claim 2, wherein said non-reactive gas comprises nitrogen gas.

8. An apparatus for neutralizing charged bodies in accordance with claims 2, wherein said non-reactive gas comprises a mixed gas of nitrogen gas and argon gas.

9. An apparatus for neutralizing charged bodies in accordance with claim 2, wherein said non-reactive gas comprises a mixed gas in which xenon gas is added to nitrogen gas.

10. An apparatus for neutralizing charged bodies in accordance with claim 2, wherein said non-reactive gas comprises a mixed gas in which xenon gas is added to argon gas.

11. An apparatus for neutralizing charged bodies in accordance with claim 2, wherein said non-reactive gas comprises a mixed gas in which xenon gas is added to a mixed gas of nitrogen gas and argon gas.

12. An apparatus for neutralizing charged bodies in accordance with claim 2, wherein said non-reactive gas comprises argon gas.

13. An apparatus for neutralizing charged bodies, comprising:

a chamber having an interior which is capable of storing the charged bodies;

a gas input means for inputting a gas into the interior of the chamber which is non-reactive with respect to said charged bodies when said charged bodies are stored in the interior of said chamber;

a neutralization charge generating means for generating ions and electrons capable of neutralizing said charged bodies when said charged bodies are stored in said chamber; and a pressure reduction means for reducing pressure in the interior of said chamber to a level lower than atmospheric pressure; and wherein said chamber communicates, via an opening and closing mechanism, with a reaction chamber for conducting prespecified processes under reduced pressure with respect to said charged bodies.

14. An apparatus for neutralizing charged bodies in accordance with claim 13, wherein said pressure reduction means operates so as to set a pressure within said reaction chamber to a level equivalent to that of a pressure within said chamber.

* * * * *